US005395218A

United States Patent [19]

Thompson

[11] Patent Number: 5,395,218

[45] Date of Patent: Mar. 7, 1995

[54] FLUID PUMP APPARATUS

[76] Inventor: Lee H. Thompson, 4409 St. Charles Rd., Columbia, Mo. 65201

[21] Appl. No.: 183,498

[22] Filed: Jan. 19, 1994

[51] Int. Cl.[6] ..... F04B 17/04

[52] U.S. Cl. ..... 417/416; 417/417; 92/159

[58] Field of Search ..... 417/419, 417, 416, 523, 417/555.1; 92/159

[56] References Cited

U.S. PATENT DOCUMENTS

| | | | |
|---|---|---|---|
| Re. 16,693 | 8/1927 | Williams . | |
| 716,110 | 12/1902 | Rose et al. . | |
| 1,057,643 | 4/1913 | Hewitt | 92/159 |
| 1,231,615 | 7/1917 | Jones | 92/159 |
| 1,556,059 | 10/1925 | Williams | 417/416 |
| 1,562,730 | 11/1925 | Andrews . | |
| 2,177,795 | 10/1939 | Delden . | |
| 2,833,220 | 5/1958 | Robinson et al. . | |
| 2,972,709 | 2/1961 | Chabala | 417/417 |
| 3,384,021 | 5/1968 | Perron | 417/417 |
| 3,419,739 | 12/1968 | Clements . | |
| 3,433,983 | 3/1969 | Keistman et al. . | |
| 3,437,044 | 4/1969 | Hilgert . | |
| 3,836,289 | 9/1974 | Wolford et al. | 417/417 |
| 3,841,798 | 10/1974 | Rehfeld . | |
| 3,894,817 | 7/1975 | Majoros et al. . | |
| 4,002,935 | 1/1977 | Brauer . | |
| 4,374,330 | 2/1983 | Fey . | |
| 4,718,832 | 1/1988 | Takahashi . | |
| 4,903,580 | 2/1990 | Bruni | 92/158 |
| 5,085,563 | 2/1992 | Collins et al. | 417/417 |
| 5,140,905 | 8/1992 | Dhar | 92/159 |

FOREIGN PATENT DOCUMENTS

| | | | |
|---|---|---|---|
| 0257876 | 4/1926 | Italy | 417/419 |
| 3294669 | 12/1991 | Japan | 417/419 |
| 1449706 | 1/1989 | U.S.S.R. | 417/417 |
| 1608358 | 11/1990 | U.S.S.R. | 417/419 |

*Primary Examiner*—Richard A. Bertsch
*Assistant Examiner*—M. Kocharov
*Attorney, Agent, or Firm*—Hovey, Williams, Timmons & Collins

[57] ABSTRACT

A fluid pump apparatus includes an elongated chamber within which a pair of pistons are movable. The chamber includes an intermediate inlet and outlets at the ends thereof. The pistons are formed of para-magnetic material and include passageways for providing fluid communication between the inlet and the outlets. An external magnetic drive system oscillates the pistons back and forth within the chamber, and includes two pairs of electrically conductive windings, wherein each pair surrounds the chamber at a position between the inlet and one of the outlets. The windings are energized in such a way that they cause the pistons to oscillate in unison with one another. Valves are provided for permitting fluid flow through the passageways in a direction from the inlet toward the outlets, and for permitting fluid flow from the chamber through the outlets. These valves also prevent fluid flow in the reverse direction.

15 Claims, 2 Drawing Sheets

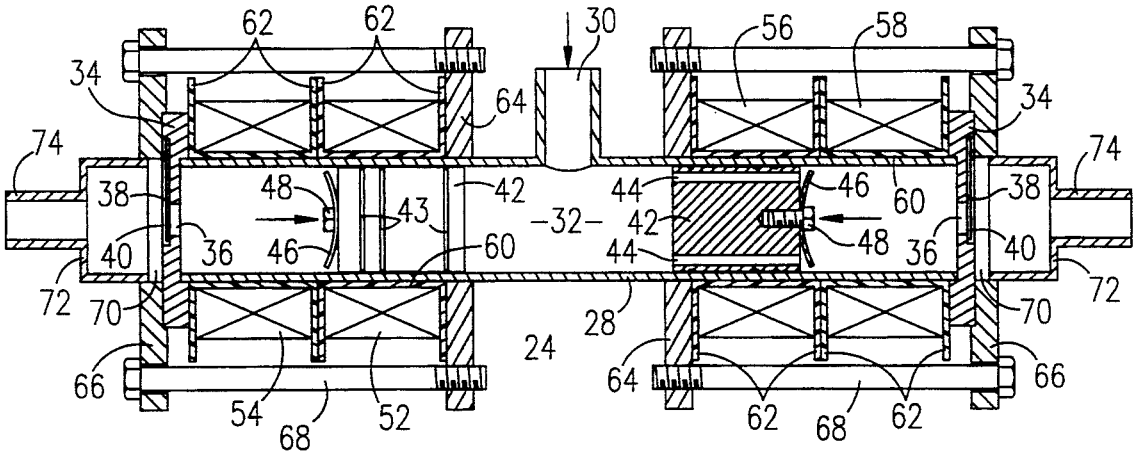
FIG. 5.
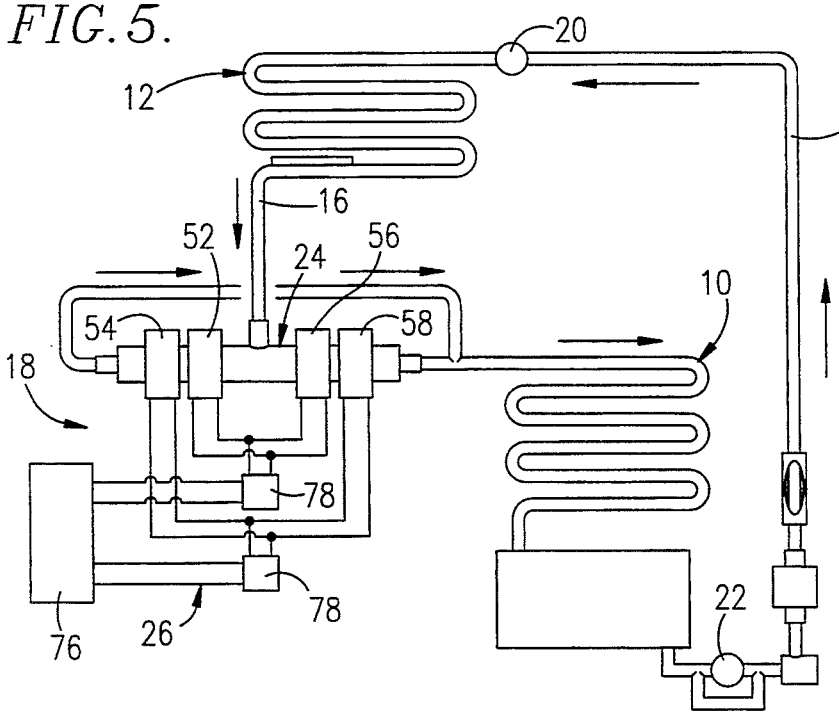
FIG. 6.
FIG. 7.
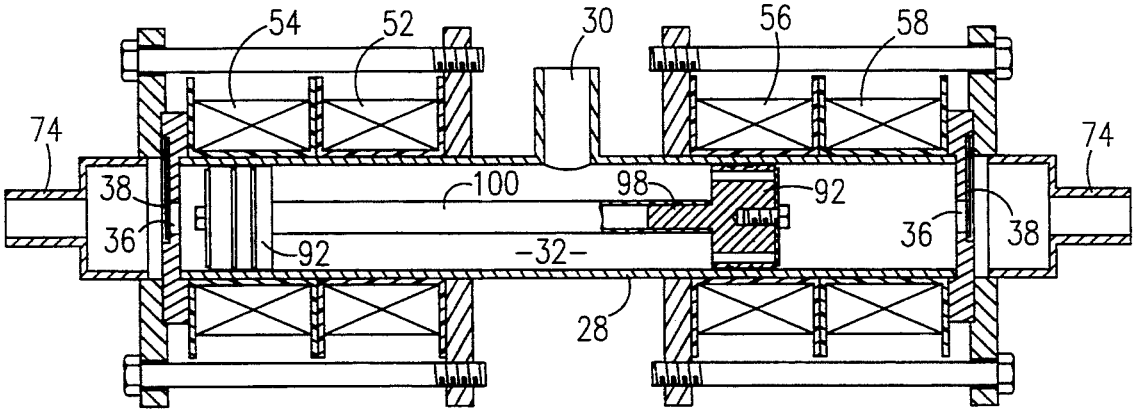

FLUID PUMP APPARATUS

BACKGROUND OF THE INVENTION

1. Field of the Invention

The present invention relates to compressors and other fluid pumps, and particularly to a fluid pump apparatus that is powered by an electromagnetic drive system.

2. Discussion of the Prior Art

Refrigeration-cycle systems are used to provide cooling in everything from automobile air conditioners to commercial freezers such as those employed to cool refrigerated or frozen-food counters in grocery stores. A conventional system includes a condenser, an evaporator, liquid and suction lines connected between the condenser and the evaporator to form a closed coolant system, a compressor, and a thermostatic expansion valve in the liquid line adjacent the evaporator.

The compressor of a conventional refrigeration-cycle system is typically driven by a belt or other power takeoff mechanism connected between the compressor and a motor, and operates only in a fully on or off position. As a result, it is necessary to repeatedly turn the compressor on and off as needed, and it is not possible to simply slow operation of the compressor as desired.

This drawback of conventional compressors is evident in automobile air conditioners, where operation of the compressor in the fully on position presents a drain to the rest of the system which is perceptible to the driver as a loss of power. Because the compressor turns on and off automatically during operation of the air conditioner, surges and declines in the power of the automobile are unpredictable and can complicate operation of the vehicle.

Other drawbacks experienced in the use of conventional compressors include the need for frequent lubrication of the compressor parts, and the inability to permit easy assembly and repair of the compressor. In addition, conventional compressors are not well equipped to handle liquid in the gas line of the system. When liquid enters a conventional compressor, it prevents the pistons of the compressor from reaching the ends of their strokes, causing failure of the piston rods or crank shaft of the compressor.

OBJECTS AND SUMMARY OF THE INVENTION

It is an object of the present invention to provide a fluid pump that is simple to assemble and repair, and which is capable of operating as a pump for liquids, gases, or mixtures thereof. Another object of the invention is to provide a compressor capable of being lubricated by a lubricant carried with the fluid being pumped, and which includes a drive means that remains out of contact with the fluid.

It is another object of the invention to provide a compressor including a drive means which permits adjustment of the speed at which fluid is pumped, and which is driven without the need for a mechanical power input, so that the compressor is able to run substantially continuously at a desired speed without draining the output of a separate motor outside the apparatus.

In accordance with these and other objects evident from the following description of a preferred embodiment of the invention, a fluid pump apparatus is provided which includes an elongated chamber, a pair of pistons movable within the chamber, and a drive means for oscillating the pistons back and forth within the chamber to carry out compression or pumping of the fluid being handled. The chamber includes an outlet at each end thereof, and an inlet intermediate the ends. The pistons are formed of para-magnetic material and include passageways for providing fluid communication between the inlet and the outlets.

The drive means of the apparatus includes two pairs of electrically conductive windings, each pair surrounding the chamber at a position between the inlet and one of the outlets. A switching means simultaneously energizes one of the windings of each pair and then simultaneously energizes the other winding of each pair. As a result, the pistons are oscillated back and forth within the chamber between the windings.

A first valve means is provided in the apparatus for permitting fluid flow through the passageways in a direction from the inlet toward the outlets, and for preventing fluid flow in the opposite direction. A second valve means permits fluid flow from the chamber through the outlets while preventing fluid from entering the chamber through the outlets.

By providing a construction in accordance with the present invention, numerous advantages are realized. For example, by forming the pistons of para-magnetic material and by driving the pistons through the use of electrically conductive windings positioned outside the chamber, it is possible to remove the drive means from contact with the fluid being pumped.

Another advantage of providing a construction in accordance with the present invention resides in the adjustability in the speed of operation of the drive means, such that it is possible to regulate the rate at which fluid is pumped through the apparatus.

BRIEF DESCRIPTION OF THE DRAWING FIGURES

A preferred embodiment of the present invention is described in detail below with reference to the attached drawing figures, wherein:

FIG. 5 is a front sectional view of the apparatus with the casing removed, illustrating the pistons during movement toward an inlet of the chamber;

FIG. 6 is a schematic view of a refrigeration-cycle system incorporating a pump apparatus constructed in accordance with the preferred embodiment; and FIG. 7 is a front sectional view of a fluid pump apparatus constructed in accordance with another preferred embodiment of the present invention.

DETAILED DESCRIPTION OF THE PREFERRED EMBODIMENT

Figure 1:
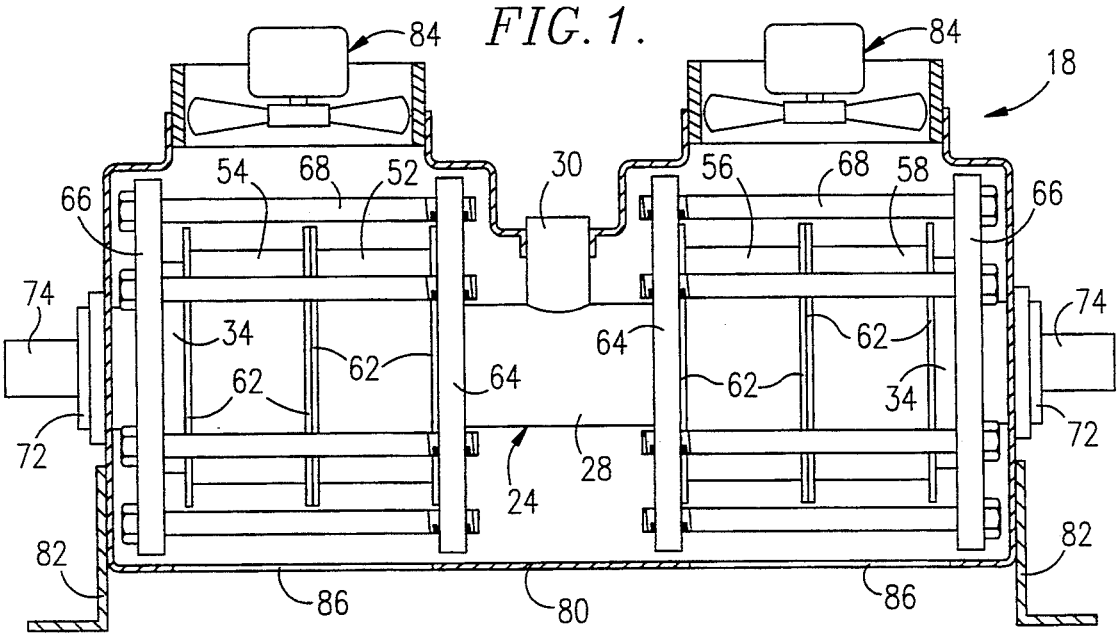
FIG. 1 is a front elevational view, partially in section, of a fluid pump apparatus constructed in accordance with the preferred embodiment.

A refrigeration-cycle system incorporating a compressor constructed in accordance with the present invention is illustrated in FIG. 6, and includes a condenser 10, an evaporator 12, liquid and suction lines 14, 16 connected between the condenser and evaporator, and the compressor 18. A thermostatic adjacent the evaporator 12, and a liquid line solenoid valve 22 may be provided in the liquid line for controlling defrost of the system.

Figure 2:
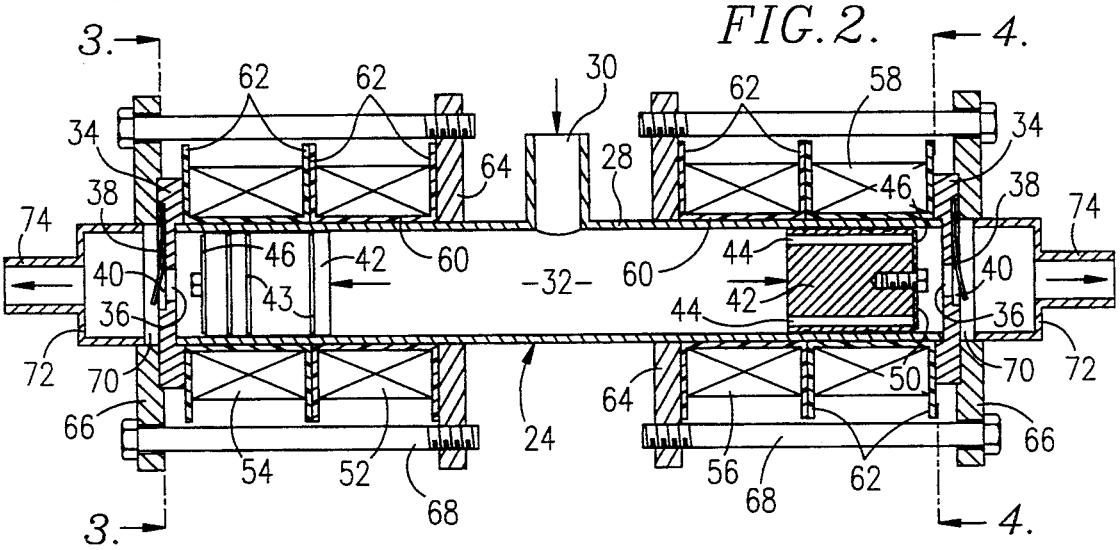
FIG. 2 is a front sectional view of the apparatus with the casing removed, illustrating a fluid chamber and a pair of pistons being moved toward opposed outlets in the chamber.

The compressor 18 broadly includes a piston and cylinder assembly 24 and a drive means 26 for operating the assembly to carry out a pumping action for pumping fluid from the evaporator to the condenser. Turning to FIG. 2, the piston and cylinder assembly is illustrated as including an elongated, hollow cylindrical tube 28 presenting opposed open axial ends and including a transverse inlet 30 provided half way between the ends.

The tube 28 is formed of a non-magnetic material, e.g. stainless steel, and presents an inner cylindrical surface which defines a fluid receiving chamber 32. The inner surface of the tube is machined to a smooth finish and is free of openings other than the inlet and the opposed axial ends. Preferably, the tube is formed of a thickness sufficient to withstand fluid pressures in excess of 1200 psi and to withstand any mechanical loading expected during use of the apparatus. However, the thickness of the tube should not be so excessive as to adversely effect the strength of electromagnetic fields created within the tube by the drive means, as described below.

An end plate 34 is provided at each axial end of the tube 28, and includes an inner surface provided with a circular recessed area sized to receive an end of the tube. Each end plate 34 is formed of stainless steel, and the end plates completely close off the axial ends of the tube 28, except for outlet openings 36 extending through the plates between the chamber and the area outside the chamber.

Figure 3:
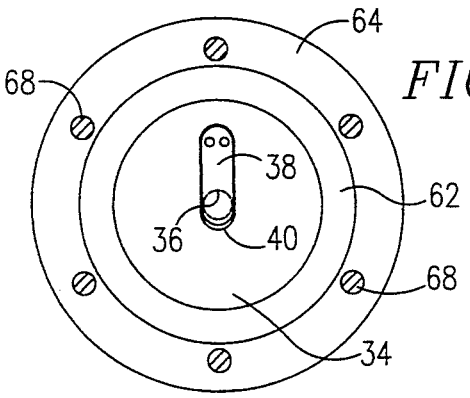
FIG. 3 is a sectional view taken along line 3—3 of FIG. 2, illustrating a valve provided at an outlet end of the chamber.

A valve means is supported on each end plate for permitting fluid flow from the chamber through the outlet and for preventing fluid flow into the chamber through the outlet. Preferably, as shown in FIG. 3, this valve means is a resilient reed valve 38 secured to the outer surface of each end plate 34 by a pair of pins extending through one axial end of the valve.

The valve includes a free end opposite the pins which normally covers the opening but which is moved away from the opening when a positive pressure is exerted on the reed valve from within the chamber 32 or when a vacuum is created in the area outside the chamber adjacent the valve. Because the material of the valves is resilient, a fluid pressure differential within the outlet openings 36 lifts the valves from the seated position shown in FIG. 5 to a raised position, shown in FIG. 2, permitting fluid flow through the outlet openings 36 from the chamber 32.

Returning to FIG. 2, a recess 40 is provided in the outer surface of each end plate 34 for receiving the reed valve. The recessed area extends around the opening to define a seat against which the valve normally rests.

A pair of pistons 42 are provided within the tube 28, each being movable within the chamber between the inlet 30 and one of the outlets 36. Each piston 42 is formed of para-magnetic material such as a soft iron, and is cylindrical in shape, presenting a cylindrical side surface of a diameter substantially equal to the inner diameter of the tube and opposed end surfaces. Preferably, the clearance between the side surface of each piston and the inner surface of the tube is about 0.002 inches. Each piston is provided with a plurality of annular grooves 43 formed in the side surface, each having a width of about 0.0625 inches and a depth of about 0.015 inches. These grooves 43 define reservoirs within which lubricant is retained during operation of the apparatus. Preferably, lubricant will be added to the refrigerant or other fluid being pumped so that lubricant is constantly supplied to the interface between the pistons and the tube.

Figure 4:
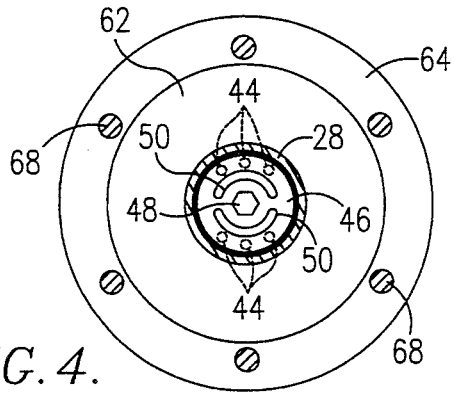
FIG. 4 is a sectional view taken along line 4—4 of FIG. 2, illustrating a valve provided on an end of one of the pistons.

As shown in FIG. 4, each piston includes six parallel passageways 44 extending completely through the piston between the end faces. These passageways 44 provide fluid communication between the inlet 30 and the outlets 36 of the chamber 32. A valve means is provided on each piston for permitting fluid flow through the passageways 44 in a direction from the inlet toward the outlets and for preventing fluid flow through the passageways in a direction from the outlets toward the inlet.

Each valve means includes a circular flapper valve 46 formed of a thin, flat circular piece of resilient material which is attached to the outer end face of one of the pistons 42 by a threaded fastener or the like 48. Each valve 46 is formed with a pair of opposed arcuate slots 50 spaced radially inward from the passageways so that the valve presents an arcuate outer section that normally covers the passageways and seats against the end face of the corresponding piston to prevent fluid flow through the passageways 44. However, because the material of the valves is resilient, a positive fluid pressure within the passageways or a negative pressure in the area between the pistons and the outlets lifts the valves from the seated position shown in FIG. 2 to a raised position, shown in FIG. 5, permitting fluid flow through the passageways from the inlet 30 toward the outlets 36.

The drive means for operating the piston and cylinder assembly is illustrated in FIG. 6, and includes two pairs of electrically conductive windings 52, 54, 56, 58 each surrounding the chamber at a position between the inlet and one of the outlets. As shown in FIG. 2, the windings 52, 54, 56, 58 are substantially identical to one another, each being a common wound magnetic coil provided around a plastic sleeve 60 that is sized to slide onto and off of the tube 28. Each winding includes side plates 62 formed of bakelite or plastic for electrically insulating the winding from adjacent windings or other structure. In one exemplary construction of the invention, each winding is formed of 1200 winds of 18 gauge copper wire that has been treated to prevent vibration during energization of the winding. However, the particular construction used for a given pump apparatus will depend upon the application.

A securing means is provided for securing each pair of windings 52, 54 and 56, 58 on the tube. Each securing means includes an annular inner flange 64 fixed to the tube adjacent the inlet, an annular outer flange 66 removable from the tube, and a plurality of threaded connectors 68 extending between the flanges 64, 66 and securing them together to hold the corresponding pair of windings 52, 54 or 56, 58 in place on the tube. Preferably, the flanges 64, 66 and connectors 68 are formed of stainless steel, and the outer flange includes a recessed area sized for receipt of one of the end plates 34 so that the end plates are also retained in place by the securing means.

Each of the outer flanges 66 is provided with a central opening 70 aligned with the outlet opening 36 in the corresponding end plate 34 and sized of a diameter substantially equal to the inner diameter of the tube 28.

A cup-shaped cap 72 is provided on each outer flange over the opening 70, and defines a discharge chamber into which fluid is released as it passes through the outlet opening 36 past the valve 38. Each cap 72 includes a threaded outlet 74 adapted for connection to the line extending to the condenser.

Turning to FIG. 6, the drive means also includes a switching means for controlling energization of the windings to drive the pistons back and forth within the fluid chamber. The switching means includes a switching mechanism 76 movable between a first switched position in which one of the windings 52, 56 of each pair is energized simultaneously, and a second switched position in which the other winding 54, 58 of each pair is energized simultaneously. The switching mechanism moves between the two switched positions to oscillate the pistons back and forth within the chamber and within the fields created within the chamber by the windings when the windings are energized.

The switching mechanism preferably includes a solid state variable speed switching assembly, but may be constructed of a contact-type time delay assembly. Either of these types of switching mechanisms includes control means for adjusting the speed at which the mechanism moves between the switched positions. Thus, it is possible to adjust the speed of oscillation of the pistons, and thereby the rate at which fluid is compressed or pumped by the apparatus. The circuit of the drive means also includes rectifiers 78 which cut off peaks in the current to the windings, keeping the windings cool.

As shown in FIG. 6, each pair of windings 52, 54 and 56, 58 defines an inner winding 52, 56 adjacent the inlet and an outer winding 54, 58 remote from the inlet, and the switching mechanism is connected to the windings so that when the mechanism is in the first switched position the inner winding 52 of one winding pair is energized simultaneously with the inner winding 56 of the other pair, and when the mechanism is in the second switched position the outer winding 54 of the one pair is energized simultaneously with the outer winding 58 of the other pair. The switching mechanism alternates between the two switched positions to oscillate the pistons back and forth within the chamber.

By providing this arrangement of the switching assembly, the two pistons are always moved in opposite directions to one another so as to minimize vibration of the apparatus. If desired, stops may be provided on the inner surface of the tube 28 adjacent the inlet 30 in order to limit inward movement of the pistons. The end plates 34 limit outward movement of the pistons.

As shown in FIG. 1, the apparatus is illustrated as being housed within a metal casing 80 provided with a pair of legs 82 by which the apparatus is supported on a base. A fan 84 is mounted on the housing in association with each pair of windings, and the fans are operated during use of the apparatus to cool the windings. Ventilation openings 86 are provided in the bottom of the metal casing for improving air flow around the windings.

During operation, AC power is supplied to the switching mechanism 76 which directs current alternately between the inner windings 52, 56 and the outer windings 54, 58 so that the pistons 42 are oscillated back and forth within the chamber. During energization of the outer windings 54, 58, the pistons are drawn into the electromagnetic fields of the outer windings, and move toward the outlets 36. During this movement, the flapper valves 46 on the pistons remain seated, preventing fluid from passing through the passageways 44 while drawing fluid into the chamber through the inlet 30. At the same time, the reed valves 38 at the outlets 36 are forced open by the positive pressure of fluid in the chamber 32, allowing fluid between the pistons and the outlets to be discharged.

During energization of the inner windings 52, 56, the pistons 42 move toward the inlet 30, creating a negative pressure in the areas between the pistons and the outlets which moves the flapper valves 46 from the seated position so that fluid passes through the passageways toward the outlets. During this movement of the pistons, the reed valves 38 remain seated against the openings 36 in the end plates to prevent fluid from entering the outlets from the discharge chambers defined within the caps 72.

By repeatedly toggling the switching mechanism between the two switched positions, fluid is drawn into the chamber 32 through the inlet 30 during outward movement of the pistons 42 and is forced through the passageways 44 in the pistons as the pistons move inward. During subsequent outward movement of the pistons, the fluid adjacent the outlets 36 is discharged as another volume of fluid is drawn into the chamber.

An alternate embodiment of the pump apparatus is shown in FIG. 7. This apparatus is substantially identical to the apparatus illustrated in FIGS. 1–6, except that the pistons 92 are connected together and the switching mechanism 76 is connected differently than in the first described embodiment.

Preferably, the pistons 92 in the modified embodiment are provided with axially extending shafts 98 which are received within a hollow connector 100 formed of non-magnetic material such as polybutelene. By connecting the pistons together, they move as a unit within the fluid chamber.

In order to drive the pistons during operation of the apparatus, the switching mechanism is connected to the windings 52, 54, 56, 58 in such a way that when the mechanism is in a first switched position the inner winding 52 of one winding pair is energized simultaneously with the outer winding 58 of the other pair, and when the mechanism is in a second switched position the outer winding 54 of the one pair is energized simultaneously with the inner winding 56 of the other pair. Thus, as the switching mechanism alternates back and forth between the two switched positions, the pistons are oscillated back and forth as a unit within the chamber.

Although the invention has been described with reference to the preferred embodiments illustrated in the attached drawing figures, it is noted that substitutions may be made and equivalents employed herein without departing from the scope of the invention as recited in the claims. For example, a fluid pump apparatus constructed in accordance with the present invention may include more than a single fluid chamber, or any desired number of pistons within the chamber. By coordinating operation of multiple piston and cylinder assemblies in a single device, it is possible to reduce vibration of the apparatus.

What is claimed is:

1. A fluid pump apparatus comprising: a tube defining an elongated chamber presenting opposed axial ends and including an outlet at each end and a single inlet intermediate the ends;

a pair of pistons, each movable within the chamber between the inlet and one of the outlets, the pistons being formed of para-magnetic material and including passageways for providing fluid communication between the inlet and the outlets;

a drive means for oscillating the pistons back and forth within the chamber, the drive means including two pairs of electrically conductive windings, each pair surrounding the chamber at a position between the inlet and one of the outlets, and a switching means for simultaneously energizing one of the windings of each pair and for then simultaneously energizing the other winding of each pair, so that the pistons are oscillated in unison with one another;

a securing means for securing each pair of windings on the tube, each securing means including an annular inner flange fixed to the tube adjacent the inlet, an annular outer flange removable from the tube, and a threaded connector extending between the flanges and securing them together to hold the corresponding pair of windings in place on the tube;

a first valve means for permitting fluid flow through the passageways in a direction from the inlet toward the outlets, and for preventing fluid flow through the passageways in a direction from the outlets toward the inlet; and a second valve means for permitting fluid flow from the chamber through the outlets, and for preventing fluid flow into the chamber through the outlets.

2. A fluid pump apparatus as recited in claim 1, wherein the chamber is defined by a tube, and the pistons are cylindrical in shape and sized for sliding receipt within the tube.

3. A fluid pump apparatus as recited in claim 2, wherein the inlet is defined by a transverse opening in the tube located half the distance between the ends of the chamber.

4. A fluid pump apparatus as recited in claim 3, wherein each pair of windings defines an inner winding adjacent the inlet and an outer winding remote from the inlet, the switching means being movable between a first switched position in which the inner winding of one winding pair is energized simultaneously with the outer winding of the other pair, and a second switched position in which the outer winding of the one pair is energized simultaneously with the inner winding of the other pair, the switching means toggling between the two switched positions to oscillate the pistons back and forth within the chamber.

5. A fluid pump apparatus as recited in claim 4, wherein the drive means includes control means for controlling the speed at which the switching means moves back and forth between the first and second switched positions.

6. A fluid pump apparatus as recited in claim 3, wherein each pair of windings defines an inner winding adjacent the inlet and an outer winding remote from the inlet, the switching means being movable between a first switched position in which the inner winding of one winding pair is energized simultaneously with the inner winding of the other pair, and a second switched position in which the outer winding of the one pair is energized simultaneously with the outer winding of the other pair, the switching means toggling between the two switched positions to oscillate the pistons back and forth within the chamber.

7. A fluid pump apparatus as recited in claim 6, wherein the drive means includes control means for controlling the speed at which the switching means toggles between the first and second switched positions.

8. A fluid pump apparatus as recited in claim 2, wherein the tube is formed of stainless steel and the pistons are formed of iron.

9. A fluid pump apparatus as recited in claim 2, wherein each piston includes opposed end faces and a cylindrical side surface, the passageways extending between the end faces and being spaced from the side surfaces of the pistons.

10. A fluid pump apparatus as recited in claim 9, wherein the first valve means includes a one-way valve associated with the passageway of each piston.

11. A fluid pump apparatus as recited in claim 9, wherein the side surface of each piston includes at least one annular groove having a width of about 0.0625 inches and a depth of about 0.015 inches.

12. A fluid pump apparatus as recited in claim 9, wherein the pistons are fixed relative to one another so that they move together within the chamber.

13. A fluid pump apparatus as recited in claim 12, further comprising a connecting rod extending between and connected to the pistons, the connecting rod being formed of a non-magnetic material.

14. A fluid pump apparatus as recited in claim 1, wherein the windings are substantially identical to one another, each being wrapped around a sleeve that is sized to slide onto and off of the tube and including side plates which electrically insulate the winding from an adjacent winding.

15. A fluid pump apparatus as recited in claim 1, further comprising cooling means for cooling the drive means during operation of the apparatus.

* * * * *